US007275816B2

(12) United States Patent
Mukai et al.

(10) Patent No.: US 7,275,816 B2
(45) Date of Patent: Oct. 2, 2007

(54) INK TANK PACKAGE AND METHOD OF UNSEALING SUCH INK TANK PACKAGE

(75) Inventors: Kayo Mukai, Tokyo (JP); Hiroyuki Ishinaga, Tokyo (JP)

(73) Assignee: Canon Finetech Inc., Mitsukaido (JP)

( * ) Notice: Subject to any disclaimer, the term of this patent is extended or adjusted under 35 U.S.C. 154(b) by 392 days.

(21) Appl. No.: 10/981,638

(22) Filed: Nov. 5, 2004

(65) Prior Publication Data

US 2005/0099471 A1 May 12, 2005

(30) Foreign Application Priority Data

Nov. 7, 2003 (JP) ..... 2003-378105
Oct. 7, 2004 (JP) ..... 2004-295098

(51) Int. Cl.
*B41J 2/175* (2006.01)

(52) U.S. Cl. ..... 347/86

(58) Field of Classification Search ..... 347/85, 347/86

See application file for complete search history.

(56) References Cited

U.S. PATENT DOCUMENTS 5,953,030 A 9/1999 Ishinaga et al. ..... 347/86
6,164,769 A 12/2000 Inada et al. ..... 347/86
6,168,266 B1 1/2001 Ishinaga et al. ..... 347/86
6,283,587 B1 * 9/2001 Umemura ..... 347/86
6,286,946 B1 * 9/2001 Umemura et al. ..... 347/86
6,450,631 B1 9/2002 Hayashi et al. ..... 347/86
6,474,796 B1 11/2002 Ishinaga ..... 347/85

FOREIGN PATENT DOCUMENTS

JP 11-70971 3/1999

* cited by examiner

*Primary Examiner*—An H. Do
(74) *Attorney, Agent, or Firm*—Fitzpatrick, Cella, Harper & Scinto.

(57) ABSTRACT

An object of the present invention is to provide an ink tank package that allows an ink tank to be unloaded and unsealed without a user's worrying about spattering of the ink. The ink tank package according to the present invention includes an ink tank and a package. The package includes a container containing therein the ink tank and a lid. The lid includes a first unsealing portion and a second unsealing portion that are mutually bendably connected. Part of a sealing member for sealing an opening in the ink tank is coupled to the first unsealing portion.

15 Claims, 7 Drawing Sheets

INK TANK PACKAGE AND METHOD OF UNSEALING SUCH INK TANK PACKAGE

BACKGROUND OF THE INVENTION

1. Field of the Invention

The present invention relates to an ink tank package containing therein an ink tank provided replaceably in an ink jet recording apparatus and a method of unsealing the ink tank package.

2. Description of the Related Art

There is known an ink jet recording apparatus, in which an ink tank is replaceably provided. This replaceable ink tank is provided with an atmosphere communication port for providing communication between an interior of the ink tank and an atmosphere, in addition to an ink supplying port. The atmosphere communication port is sealed by a sealing member in an unused condition. It is also common practice that ink tanks are packed in packages when supplied to a market to prevent the ink tanks from being damaged during distribution processes or the like. To use an ink tank package containing therein an ink tank such as that described above, a package is first unsealed and it becomes thereafter necessary to peel off the sealing member of the atmosphere communication port. It is, however, likely that the ink tank will be loaded in the ink jet recording apparatus with the seal left attached. A technique for preventing this from occurring is proposed. Specifically, the sealing member is previously coupled to an unsealing portion of the package. This allows the sealing member to be peeled off when the package is unsealed. (Refer, for example, to Japanese Patent Application Laid-open No. 11-070971(1999).)

There are, however, the following problems in the conventional art.

Specifically, assume a conventional structure in which the sealing member for sealing the atmosphere communication port of an ink supplying portion and the unsealing portion of the package are coupled together. In this structure, if the sealing member is abruptly peeled of f through an abrupt pulling action of the unsealing portion, it is likely that ink in areas near the ink supplying port will spatter to an outside from the atmosphere communication port. The ink supplying port and the atmosphere communication port are independently formed in an ordinary ink tank with sealing members provided separately at two locations. When the seal on a side of the ink supplying port is peeled off after the package has been unsealed and the atmosphere communication port has been unsealed as described above, therefore, it is again likely that ink will spatter around from the ink supplying port.

SUMMARY OF THE INVENTION

In view of the foregoing problems in the conventional art, it is an object of the present invention to provide an ink tank package and a method of unsealing such an ink tank package that allows an ink tank to be unloaded easily and unsealed without a user's worrying about spattering of the ink.

To achieve the foregoing object of the present invention, according to a first aspect of the present invention, an ink tank package includes a container containing therein an ink tank and a lid unsealably blocking up an unloading port for removing the ink tank from the container. The lid of the package includes a first unsealing portion and a second unsealing portion that are mutually bendably connected together. There is provided a connection to the first unsealing portion at a part of a sealing member for sealing an opening in the ink tank.

According to a second aspect of the present invention, in a method of unsealing the ink tank package according to the first aspect of the present invention, the opening in the ink tank includes an ink supplying port for supplying ink externally and an atmosphere communication port for providing communication between an interior of the ink tank and an outside atmosphere. The sealing member seals at least the ink supplying port from the outside atmosphere.

According to a third aspect of the present invention, in the arrangement according to the second aspect of the present invention, the atmosphere communication port in the opening in the ink tank is sealed by the sealing member at a position closer to the connection in the sealing member than a position of sealing of the ink supplying port implemented by the sealing member.

According to a fourth aspect of the present invention, in the arrangement according to any one of the first to the third aspects of the present invention, the ink tank is provided with an ink absorbing body for holding ink through a capillary force.

According to a fifth aspect of the present invention, in the arrangement according to the first aspect of the present invention, there is provided a connection to the second unsealing portion at a part of a second sealing member for sealing a second opening, which is different from the opening in the ink tank.

According to a sixth aspect of the present invention, in the arrangement according to the fifth aspect of the present invention, the opening is the atmosphere communication port for providing communication between the interior of the ink tank and the outside atmosphere.

According to a seventh aspect of the present invention, in the arrangement according to the fifth aspect of the present invention, the second opening is the ink supplying port for supplying ink externally.

According to an eighth aspect of the present invention, in the arrangement according to the first through the seventh aspects of the present invention, the ink tank is removably mounted in an ink jet recording apparatus performing recording operations by discharging ink.

According to a ninth aspect of the present invention, a method of unsealing the ink tank package according to the first aspect of the present invention includes the steps of: unsealing the first unsealing portion from the unloading port prior to the second unsealing portion, whereby peeling the sealing member of f the opening in the ink tank; and unsealing the second unsealing portion from the unloading port, whereby allowing the ink tank to be unloaded from the container.

According to a tenth aspect of the present invention, a method of unsealing the ink tank package according to the third aspect of the present invention includes the steps of: unsealing the first unsealing portion from the unloading port, whereby involving the sealing member being peeled off the atmosphere communication port and the ink supplying port, in that order; and unsealing the second unsealing portion from the unloading port, whereby allowing the ink tank to be unloaded from the container.

According to an eleventh aspect of the present invention, a method of unsealing the ink tank package according to the fifth aspect of the present invention includes the steps of: unsealing the first unsealing portion from the unloading port prior to the second unsealing portion, whereby peeling the first sealing member off the atmosphere communication port in the ink tank; and unsealing the second unsealing portion from the unloading port, whereby peeling the second sealing member off the ink supplying port of the ink tank and allowing the ink tank to be unloaded from the container.

According to a twelfth aspect of the present invention, in the arrangement according to the ninth to the eleventh aspects of the present invention, the ink tank is removably mounted in an ink jet recording apparatus performing recording operations by discharging ink.

For the purpose of this specification and claims contained therein, the ink tank package includes at least the ink tank and an accommodating portion containing the ink tank therein.

In the invention described in the foregoing, the first unsealing portion and the second unsealing portion making up the lid are bendably connected to each other. Then a sequence of unsealing occurs in a stepwise fashion as follows. Specifically, during unsealing, the first unsealing portion is first unsealed in a condition bent relative to the second unsealing portion. The second unsealing portion is thereafter unsealed. The sealing member is therefore peeled off the opening in the container at a relatively mild pace. Moreover, the peeling of the sealing member from the opening is carried out inside the container. This allows the user to unseal the package and unload the ink tank without having to worry particularly about the ink's spattering to the outside. In addition, the following effect may be noticed in the structure in which the opening in the ink tank includes the ink supplying port for supplying ink externally and the atmosphere communication port for providing communication between the interior of the ink tank and the outside atmosphere. Specifically, the sealing member opens the atmosphere communication port before the ink supplying port during the operation of unsealing the lid. This means that the ink supplying port is opened in a condition of a decreased internal pressure inside the container, should there be an internal pressure buildup in the container due to an increased temperature. This effectively prevents the ink from leaking from the ink supplying port.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Ink tank packages and unsealing methods thereof according to preferred embodiments of the present invention will be described with reference to the accompanying drawings. Each of the ink tank packages in accordance with the preferred embodiments of the present invention to be described hereunder includes an ink tank and a package containing therein the ink tank.

Embodiment 1

Figure 1A:
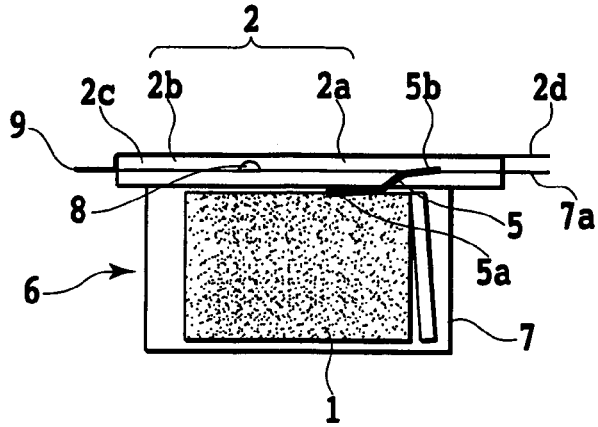
FIG. 1A is a cross-sectional view showing an ink tank package according to a first preferred embodiment of the present invention in an initial state thereof.
Figure 1B:
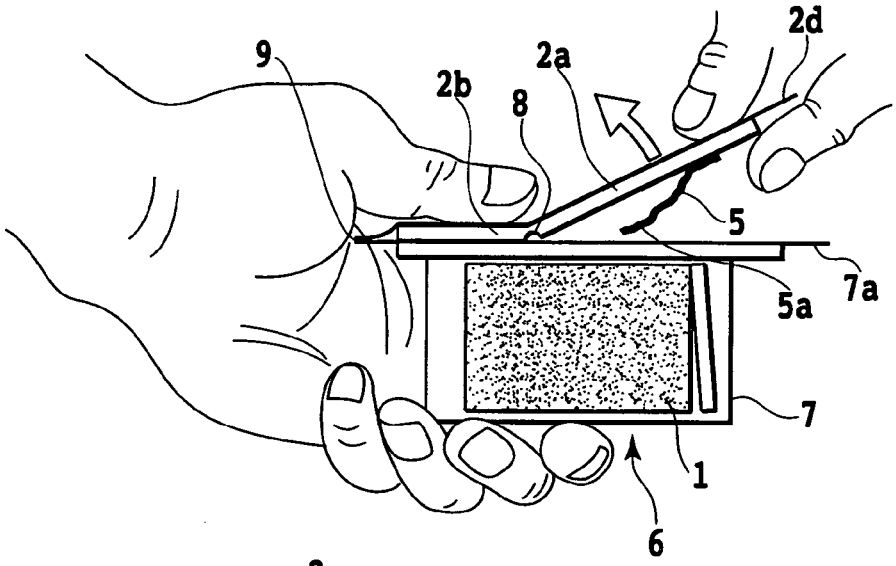
FIG. 1B is a cross-sectional view showing the ink tank package according to the first preferred embodiment of the present invention, in which a first unsealing portion is unsealed.
Figure 1C:
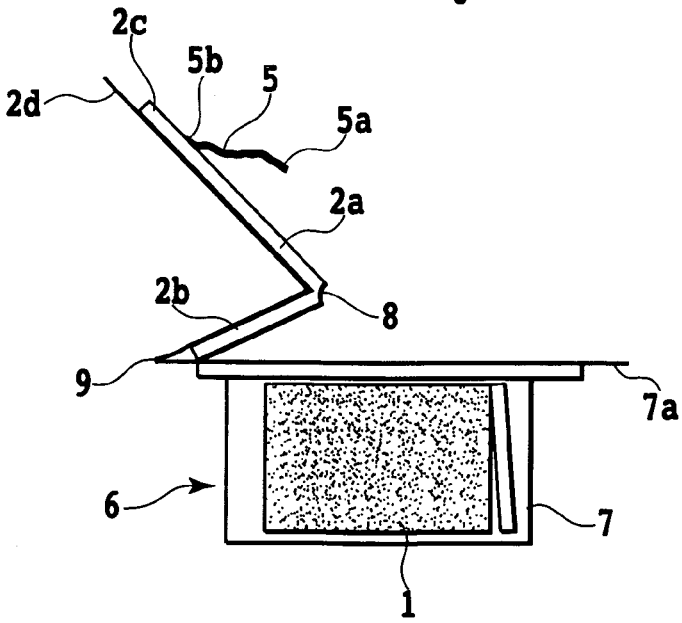
FIG. 1C a cross-sectional view showing the ink tank package according to the first preferred embodiment of the present invention, in which a second unsealing portion is unsealed.

FIGS. 1A, 1B, and 1C show cross-sectional views of an ink tank package according to a first embodiment of the present invention.

An ink tank 1 is packed in a package 6 made of PET, PP, or a laminated structure of these materials. The package 6 includes a container 7 of a recessed shape for accommodating therein the ink tank 1 and a lid 2. The lid 2 includes a first unsealing portion 2*a* and a second unsealing portion 2*b* that are bendably connected to each other by a hinge 8.

According to the first preferred embodiment of the present invention, the lid 2 includes a one-piece molded frame member 2*c* having a relatively thick wall and a transparent sheet member 2*d* for covering an opening in the frame member 2*c*. The hinge 8 is formed by recesses formed at two mutually opposing sides of the frame member 2*c*. The hinge (recesses) 8 allows the first unsealing portion 2*a* and the second unsealing portion 2*b* of the frame member 2*c* to be bent. In addition, a frame-shaped protrusion 7*a* protruding outwardly is formed on an upper surface of the container 7. One side of the protrusion 7*a* is bendably connected to the sheet member 2*d* protruding from one side of the second unsealing portion 2*b*. This bendable portion forms a second hinge 9 connecting the second unsealing portion 2*b* and the container 7.

Openings in the ink tank 1, or an ink supplying port and an atmosphere communication port, are formed on an upper surface of the ink tank 1. The ink supplying port and the atmosphere communication port are sealed by a sealing portion 5*a* formed on one end of a band-shaped single sealing member 5. An attaching portion 5*b* formed on the other end of the sealing member 5 is firmly fixed to the first unsealing portion 2*a* of the lid 2 through thermal welding or the like. The container 7 and the lid 2 are shaped through vacuum forming or the like. The sheet member 2*d* of the lid 2 and the protrusion 7*a* of the container 7 are peelably bonded to each other. Housing the ink tank 1 in the package 6 in the fashion as described in the foregoing protects the ink tank 1 from an external force, thus giving the ink tank 1 a high storage performance.

FIG. 1A shows an initial state. FIG. 1B shows a condition, in which the first unsealing portion 2*a* is unsealed with the second unsealing portion 2*b* held in position by a hand. At a point in time depicted in FIG. 1B, the second unsealing portion 2*b* is yet to be unsealed and the sealing portion 5*a* of the sealing member 5 is being peeled off the ink tank I at a mild pace.

Spattering of ink in areas near the openings will not therefore occur. Ink in the ink tank 1 may accidentally leak to the outside depending on the environmental condition, and in particular, when the atmospheric pressure at the time of unsealing is significantly low. Even if this happens, however, the ink is received in the container 7 of the package 6. Thus, it is highly unlikely that the user's hand or clothing will be dirtied with the ink.

FIG. 1C shows a condition, in which the second unsealing portion 3 has been unsealed. In this condition, the user can now take out the ink tank 1.

Figure 4A:
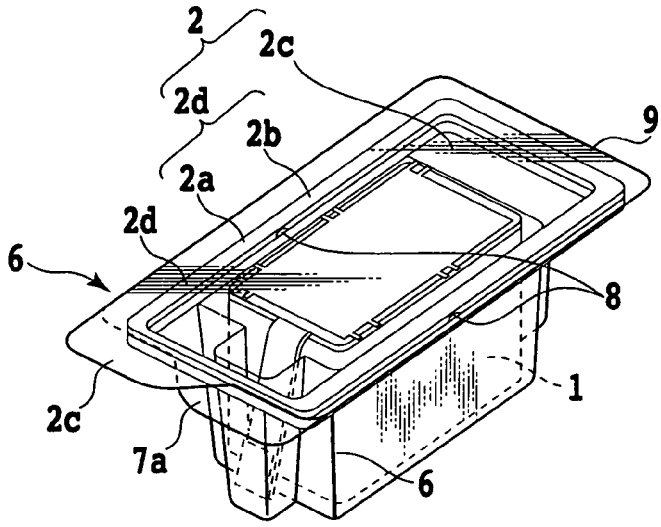
FIG. 4A is a perspective view corresponding to the view shown in FIG. 1A.
Figure 4B:
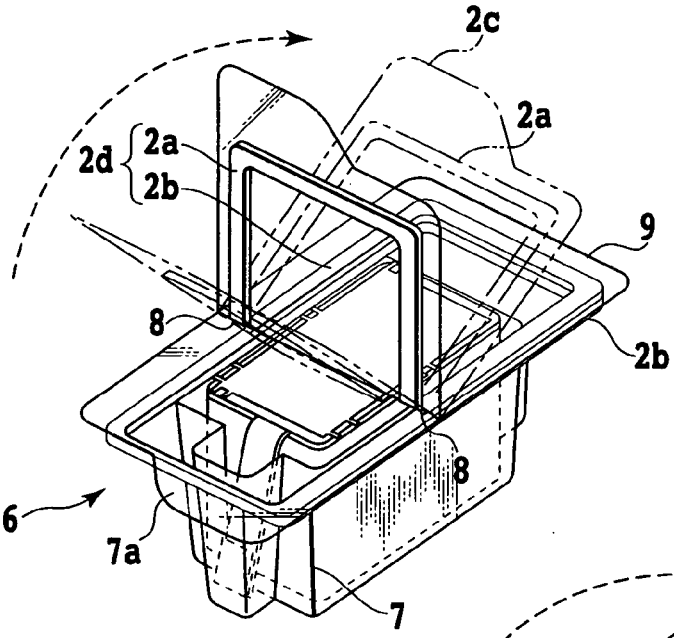
FIG. 4B is a perspective view corresponding to the view shown in FIG. 1B.
Figure 4C:
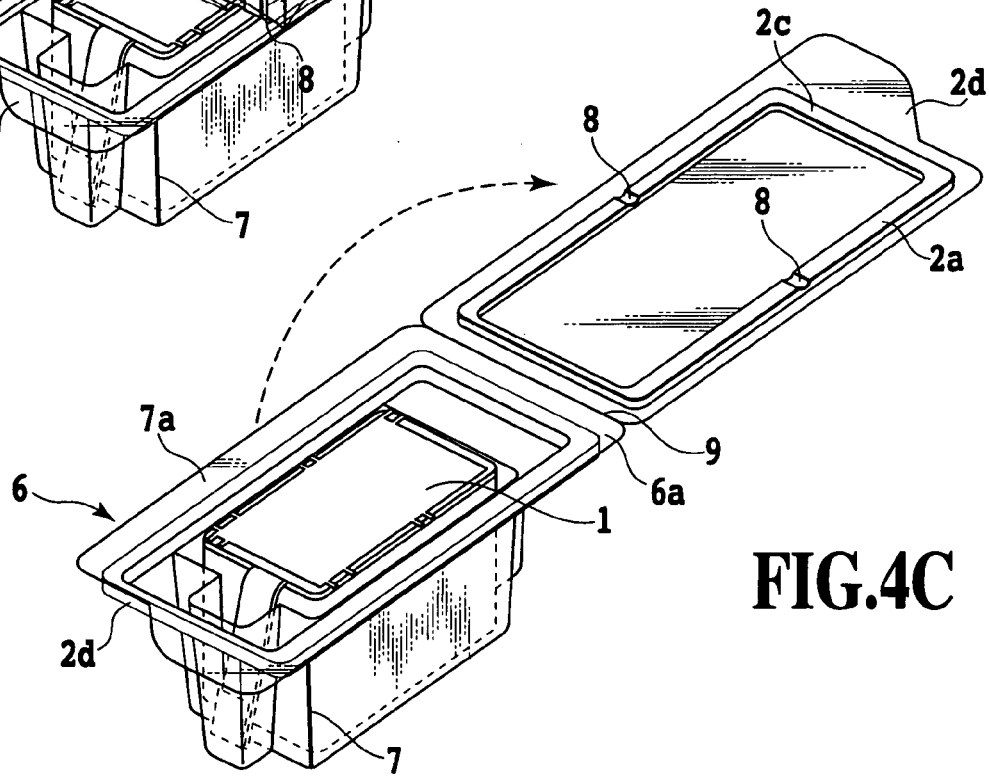
FIG. 4C is a perspective view corresponding to the view shown in FIG. 1C.

FIGS. 4A, 4B, and 4C are perspective views corresponding to FIGS. 1A, 1B, and 1C, respectively.

Figure 7:
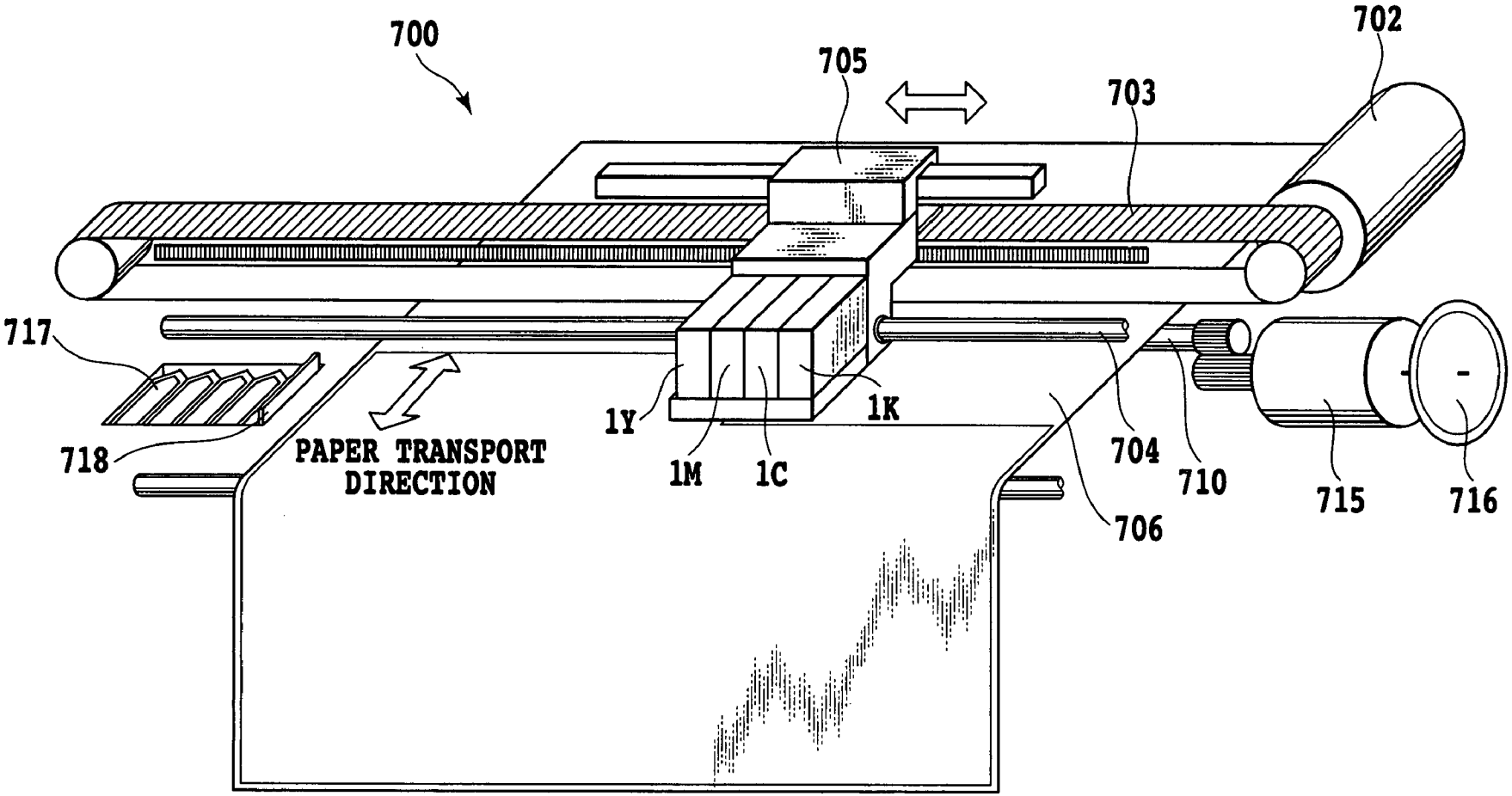
FIG. 7 is a perspective view showing an ink jet recording apparatus mounted with an ink tank, to which the present invention is applied.

FIG. 7 is a perspective view showing an ink jet recording apparatus 700 mounted with the ink tank 1 that has been removed from the package 6 according to the present invention.

Specifically, the ink jet recording apparatus 700 includes a carriage 705. The carriage 705 travels along a guide shaft 704 with a timing belt 703 that makes a reciprocating motion in a longitudinal direction as driven by a carriage motor 702. A plurality of ink tanks 1K, 1C, 1M, and 1Y for storing ink of a plurality of kinds are removably mounted on the carriage 705. An ink supplying port located on an underside of each of these ink tanks is coupled to a corresponding recording head not shown.

The ink tank 1K stores black ink, the ink tank 1C stores cyan ink, the ink tank 1M stores magenta ink, and the ink tank 1Y stores yellow ink. Each of these ink tanks 1K, 1C, 1M, and 1Y is constructed as described in the foregoing.

The ink jet recording apparatus 700 is also provided with a transport roller 710 for transporting a recording medium 706 intermittently after the carriage 705 has been moved. The transport roller 710 is rotated through the operation of a transport motor 715. A transport sequence by the transport roller 710 and a recording scan sequence by the recording head not shown and mounted on the carriage 705 are alternately carried out so that an image is sequentially formed on a sheet of the recording medium 706.

There is coupled a rotary encoder 716 to a rotary shaft of the transport motor 715. The rotary encoder 716 is used for detecting a position of the rotary shaft and controlling a rotational speed of the rotary shaft.

A cap 717 is provided at an area that falls within a range of reciprocating movement of the carriage 705, in which no recording action occurs relative to the recording medium 706. The cap 717 ensures that an adequate ink discharge performance is maintained for each of the recording heads. There are four caps 717 provided, each corresponding to each of the four recording heads.

There is provided a wiper blade 718 that wipes an end face of each recording head clean of ink. When the recording head is moved from a position, at which the head is capped by the cap 717, toward a recording area, the wiper blade 718 comes into play to wipe a nozzle orifice forming surface of the recording head clean of ink as part of a recovery sequence.

Embodiment 2

Figure 2A:
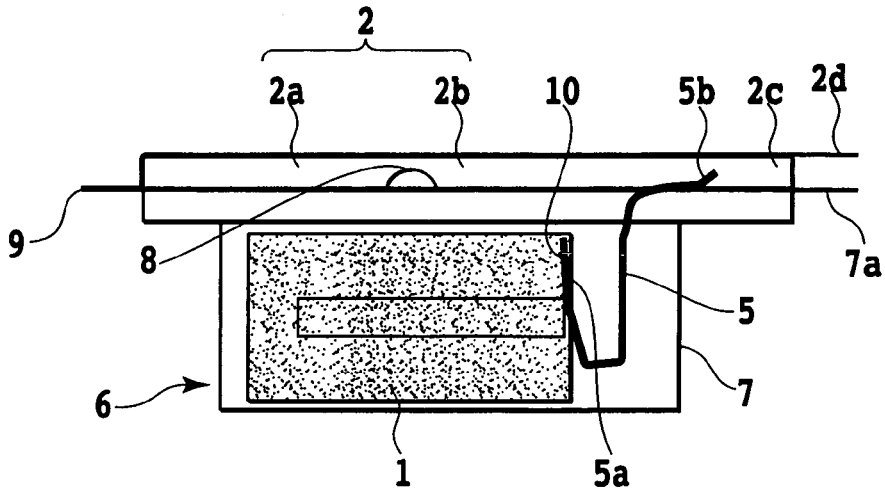
FIG. 2A is a cross-sectional view showing an ink tank package according to a second preferred embodiment of the present invention in an initial state thereof.
Figure 2B:
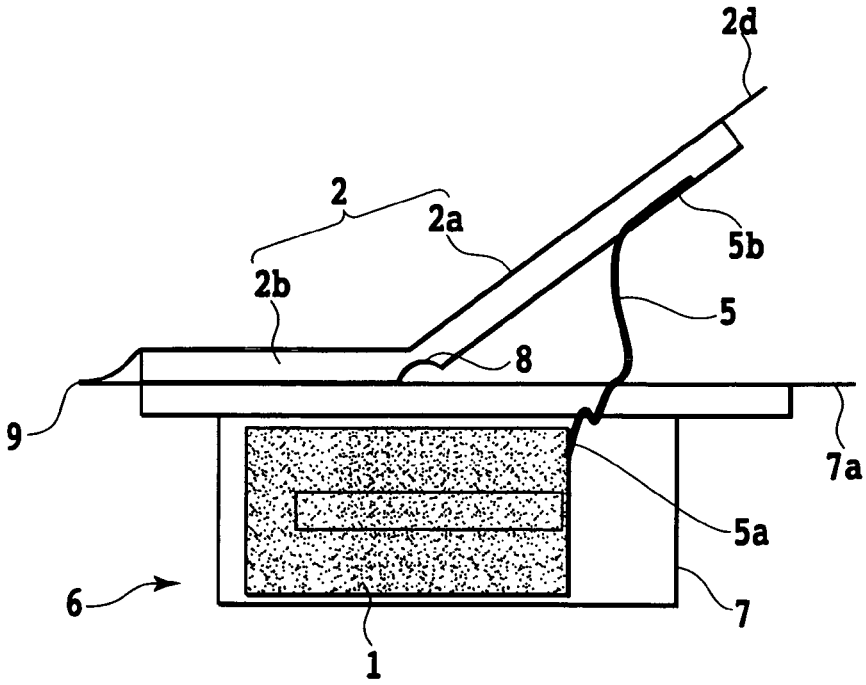
FIG. 2B is a cross-sectional view showing the ink tank package according to the second preferred embodiment of the present invention, in which a first unsealing portion is unsealed.

FIGS. 2A and 2B show an ink tank package according to a second preferred embodiment of the present invention. In FIGS. 2A and 2B, like or corresponding parts are identified by the same reference numerals as in FIGS. 1A, 1B, and 1C showing the ink tank package according to the first preferred embodiment of the present invention.

In the ink tank package according to the second preferred embodiment of the present invention, an opening 10 formed in an ink tank 1, including an ink supplying port and an atmosphere communication port, is disposed on one and the same surface perpendicular to a lid 2 before unsealing. The opening 10 is sealed by a single sealing member 5 attached to the lid 2. A sealing portion 5*a* formed on one end of the sealing portion 5*a* of a sealing member 5 is sealed to the opening 10 through thermal welding. An attaching portion 5*b* formed on the other end of the sealing member 5 is welded to a first unsealing portion 2*a* of the lid 2. In an unused condition, the sealing member 5 is held in a position curved into substantially a U shape across one end to the other end thereof.

To remove the ink tank 1 from the ink tank package as arranged as described in the foregoing, the first unsealing portion 2*a* and a second unsealing portion 2*b* are sequentially unsealed from a container 7 in the same manner as in the ink tank package according to the first preferred embodiment of the present invention. In the second preferred embodiment of the present invention, when the sealing member 5 is pulled upward together with the first unsealing portion 2, the sealing portion 5*a* of the sealing member 5 is bent into a U shape or a V shape. Herein, an unsealing force exerted on the first unsealing portion is effectively applied to a lower end of the sealing portion 5*a*. This allows a strong force to be applied in a peeling direction with respect to the sealing portion 5*a*, thus enabling smooth unsealing.

Embodiment 3

Figure 3A:
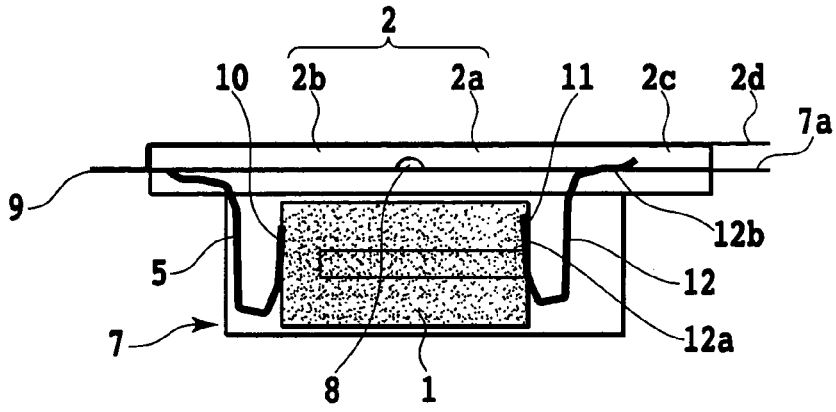
FIG. 3A is a cross-sectional view showing an ink tank package according to a third preferred embodiment of the present invention in an initial state thereof.
Figure 3B:
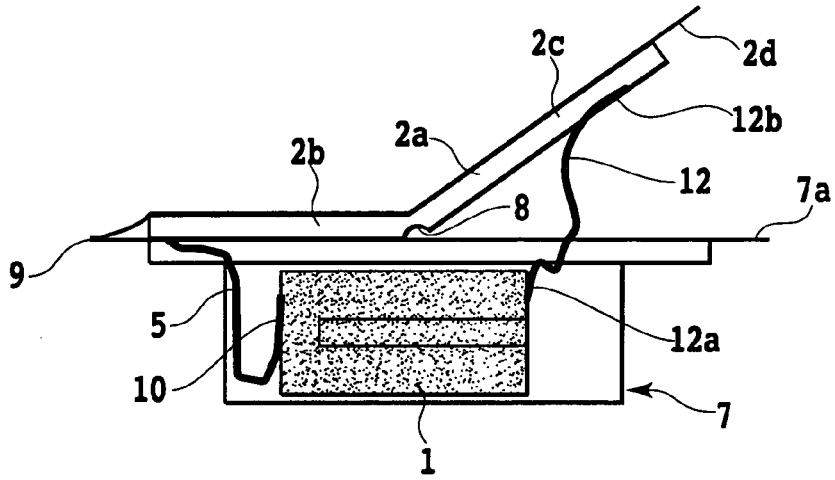
FIG. 3B is a cross-sectional view showing the ink tank package according to the third preferred embodiment of the present invention, in which a first unsealing portion is unsealed.
Figure 3C:
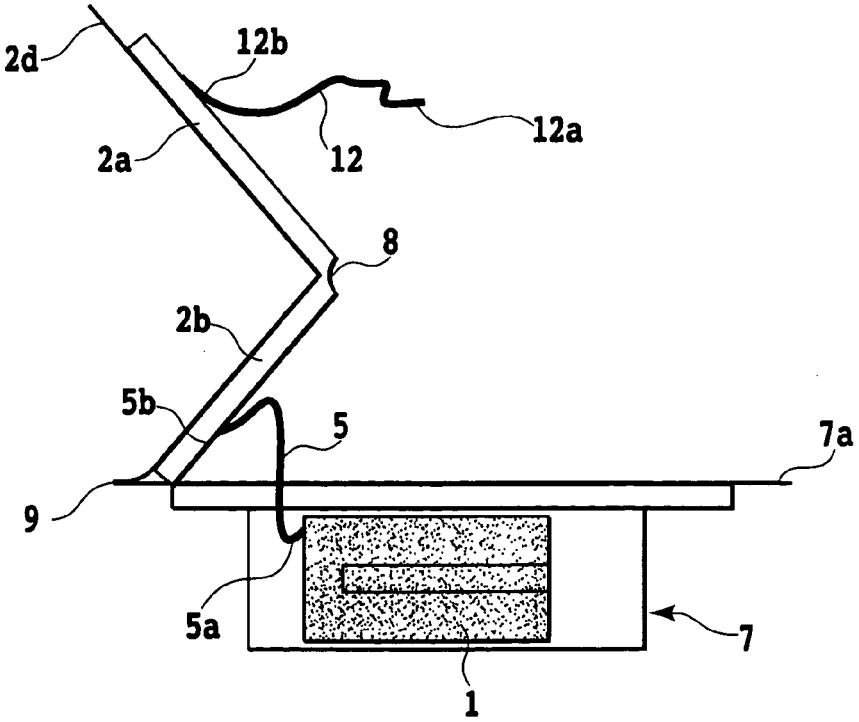
FIG. 3C a cross-sectional view showing the ink tank package according to the third preferred embodiment of the present invention, in which a second unsealing portion is unsealed.

FIGS. 3A, 3B, and 3C show an ink tank package according to a third preferred embodiment of the present invention. In FIGS. 3A, 3B, and 3C, like or corresponding parts are identified by the same reference numerals as in FIGS. 2A and 2B showing the ink tank package according to the second preferred embodiment of the present invention.

In the ink tank package according to the third preferred embodiment of the present invention, an ink tank 1 has an:ink supplying port 10 and an atmosphere communication port 11, each being disposed on a surface that is different from each other. Each of the openings 10, 11 is sealed by an independent sealing member 5 and a sealing member 12, respectively. A sealing portion 5*a* formed on one end of the sealing member 5 seals the ink supplying port 10 peelably. An attaching portion 5*b* formed on the other end of the sealing member 5 is firmly fixed to a second unsealing portion 2*b*. A sealing portion 12*a* formed on one end of the sealing member 12 seals the atmosphere communication port 11 peelably. An attaching portion 12*b* formed on the other end of the sealing member 12 is firmly fixed to a first unsealing portion 2*a*.

FIG. 3A shows an initial state. Referring to FIG. 3B, the sealing member 12 peels off to open the atmosphere communication port 11 when the first unsealing portion 2*a* is unsealed. Further, referring to FIG. 3C, the sealing member 5 peels off to open the ink supplying port 10 when the second unsealing portion 2*b* is unsealed.

The advance opening of the atmosphere communication port 11 as described above has the following effect. Specifically, even if there is an internal pressure buildup in the container due to an increased temperature, for example, the internal pressure inside the container is decreased at the same time that the atmosphere communication port 11 is opened. This effectively prevents the ink from leaking from the ink supplying port that will thereafter be opened.

Embodiment 4

Figure 5:
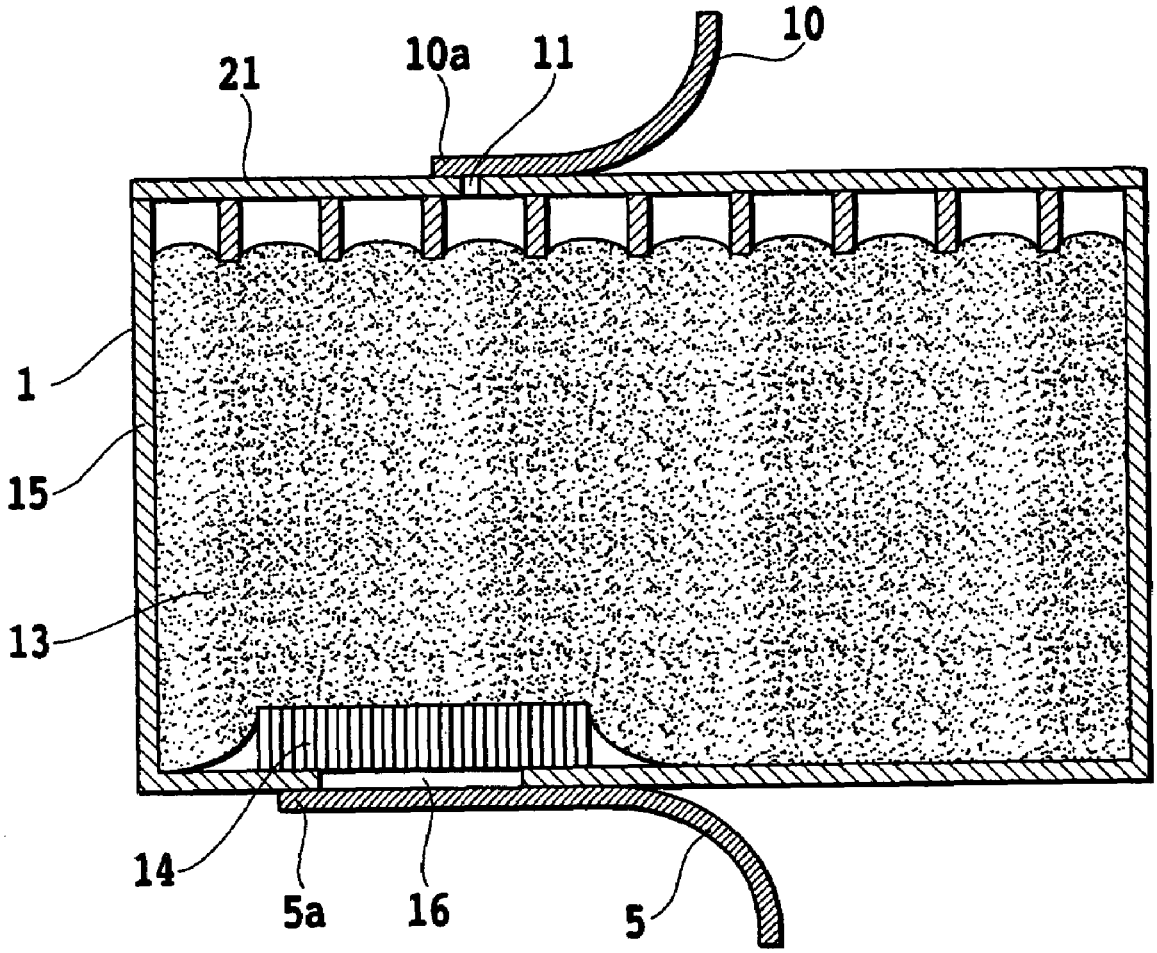
FIG. 5 is a view showing a typical internal structure of an ink tank, to which the present invention is applied.

FIG. 5 is a cross-sectional view showing a typical internal structure of an ink tank 1, to which the present invention is applied.

The ink tank 1 has a tank container 15 made of PP (polypropylene) or PE (polyethylene) and a tank lid 21 secured to an opening of the tank container 15 in an airtight condition. An atmosphere communication port 11 is formed in the tank lid 21. A supplying port 16 for supplying a print head (not shown) with ink is formed in a bottom surface of the tank container 15. In addition, an absorbing body 13 and a pressure body 14 are housed in an interior of the tank container 15. The absorbing body 13 made mainly of PP or PE absorbs ink through a capillary force. The pressure body 14 made mainly of PP or PE is disposed adjacent to the supplying port 16. The pressure body 14 promotes convergence of ink inside the absorbing body 13 toward the supplying port 5.

A sealing member 10 is welded to the supplying port 16 through thermal welding or the like. The sealing member 10 is a laminated structure including a welding layer made of PP or PE, a gas barrier layer for preventing transmission of gas or water content, and a substrate having a mechanical strength. The atmosphere communication port 11 is for introducing the atmosphere into an interior of the ink tank 1 as ink in the ink tank 1 is consumed. Sealing members 10 and 5 may at times be welded to the atmosphere communication port 11 and the supplying port 16 with the aim of preventing the ink from leaking to the outside during storage or transportation. In this case, however, the interior of the ink tank 10 is completely sealed from the outside air. This could result in an internal pressure of a cartridge being increased due to environmental changes of temperature and atmospheric pressure. For packing the ink tank 1, therefore, it is effective to use the package according to the third preferred embodiment of the present invention and adopt the unsealing method, in which the atmosphere communication port 11 is unsealed prior to the supplying port 16, thereby eliminate possible pressure difference between the inside and outside of the ink tank. In this case, too, as in the third preferred embodiment of the present invention, the sealing member 12 provided for the atmosphere communication port 11 is secured to the first unsealing portion 2*a* shown in FIGS. 3A, 3B, and 3C, and the sealing member 5 provided for the supplying port 16 is secured to the second unsealing portion 2*b*.

Embodiment 5

Figure 6:
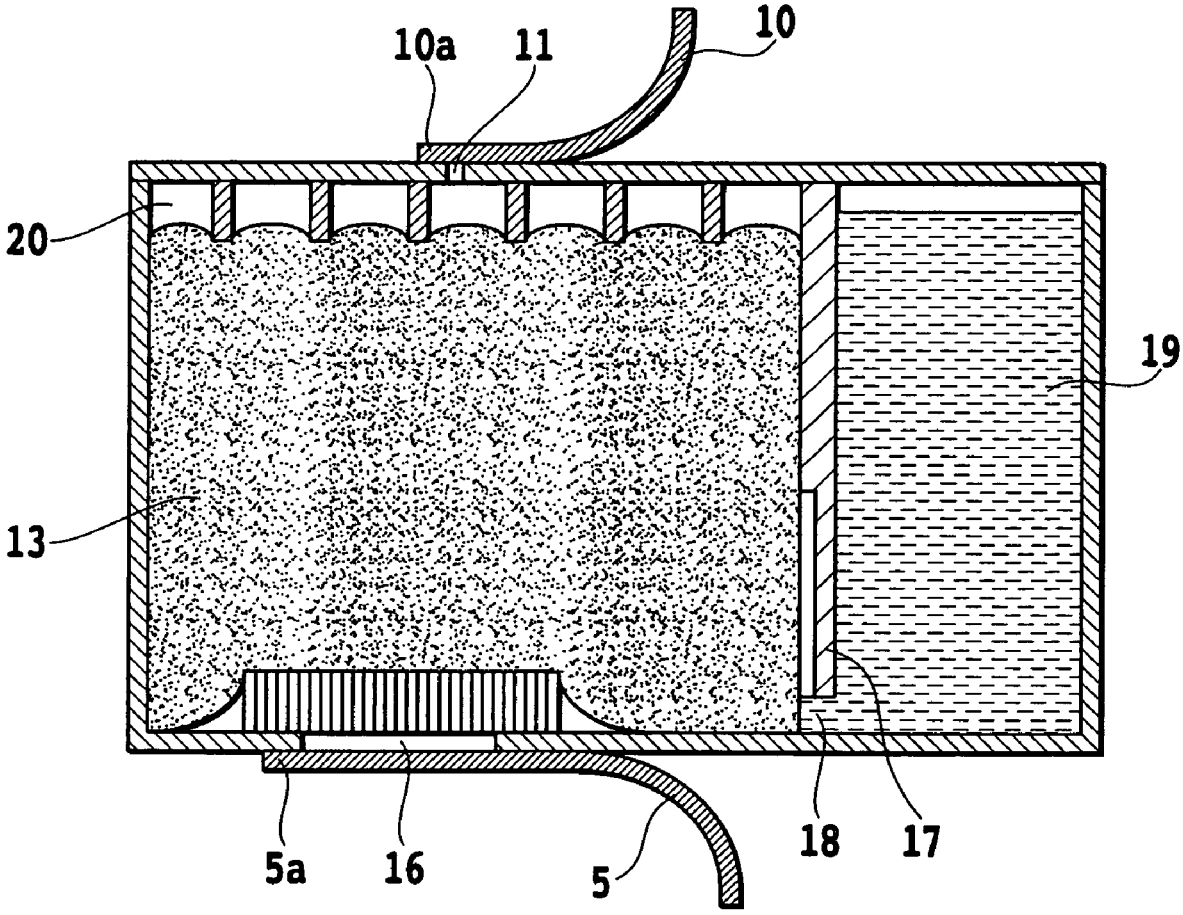
FIG. 6 is a view showing another typical internal structure of an ink tank, to which the present invention is applied.

FIG. 6 is a cross-sectional view showing another typical internal structure of an ink tank, to which the present invention is applied. In FIG. 6, like or corresponding structural parts are identified by the same reference numerals as in FIG. 5 with explanations thereof omitted.

An ink tank 1 shown in FIG. 6 is characterized by an interior space defined by a tank container 15 and a lid 21 being divided into two chambers. Specifically, the interior space of the ink tank 1 is divided into an absorbing body chamber 20 and an ink chamber 19 by a separation wall 17. The absorbing body chamber 20 houses therein an absorbing body 13. The ink chamber 19 directly stores therein ink. The absorbing body chamber 20 and the ink chamber 19 communicate with each other through a communication portion 18. With the ink tank 1 as structured as described above, ink in the ink chamber 19 moves to the absorbing body chamber 20 and can eventually leak to the outside through an opening 16 during storage or transportation. To prevent this from occurring, an atmosphere communication port 11 and an ink supplying port 16 need to be sealed with sealing members 12 and 5, respectively. Herein, there could also be involved a pressure difference between the inside and outside of the ink tank 1. This makes it necessary to release the atmosphere communication port 11 first during unsealing. This unsealing method can be achieved by using the package according to the third preferred embodiment of the present invention, as in the case of the ink tank shown in FIG. 5.

The ink tanks according to the second through fifth preferred embodiments of the present invention described heretofore can be removably mounted on the ink jet recording apparatus shown in FIG. 7 as with the ink tank according to the first preferred embodiment of the present invention.

(Modification)

It is to be understood that the present invention is not limited to the specific preferred embodiments described heretofore; rather, various changes and modifications may be made in the invention without departing from the spirit and scope of the claims thereof. For example, the lid in each of the aforementioned preferred embodiments of the present invention includes the frame member 2*c* and the sheet member 2*d* and the first unsealing portion 2*a* and the second unsealing portion 2*b* are made bendable at the recess (hinge) 8 formed in the frame member 2. In the present invention, however, any other configuration may be employed for the lid as long as the lid can unsealably block up the container and the first unsealing portion and the second unsealing portion are bendable. Other configuration specifically includes: the first unsealing portion and the second unsealing portion are formed by individual members that are connected using a bendable member such as a sheet member or the like. Furthermore, the second bendable portion may also be configured so as to be completely separable from the container through unsealing. In addition, the shape of the package may be changed as necessary according to the shape of the ink tank. It is further to be understood that the materials to be used for the members are not limited to those mentioned in the foregoing descriptions.

The present invention can be applied to packing of an ink storage body, such as a replaceable ink tank, ink cartridge, and the like used in the ink jet recording apparatus.

The present invention has been described in detail with respect to preferred embodiments, and it will now be apparent from the foregoing to those skilled in the art that changes and modifications maybe made without departing from the invention in its broader aspect, and it is the intention, therefore, in the apparent claims to cover all such changes and modifications as fall within the true spirit of the invention.

This application claims priority from Japanese Patent Application Nos. 2003-378105 filed Nov. 7, 2003 and 2004-295098 filed Oct. 7, 2004, which are hereby incorporated by reference herein.

What is claimed is:

1. An ink tank package, comprising:

a container containing therein an ink tank; and a lid unsealably blocking up an unloading port for removing the ink tank from the container;

wherein the lid of the package includes a first unsealing portion and a second unsealing portion that are mutually bendably connected together, wherein there is provided a connection to the first unsealing portion at a part of a sealing member for sealing an opening in the ink tank; and wherein there is provided a connection to the second unsealing portion at a part of a second sealing member for sealing a second opening, which is different from the opening in the ink tank.

2. The ink tank package according to claim 1, wherein the opening in the ink tank includes an ink supplying port for supplying ink externally and an atmosphere communication port for providing communication between an interior of the ink tank and atmosphere; and wherein the sealing member seals at least the ink supplying port from atmosphere.

3. The ink tank package according to claim 2, wherein the atmosphere communication port in the opening in the ink tank is sealed by the sealing member at a position closer to the connection along the sealing member than a position of sealing of the ink supplying port sealed by the sealing member.

4. The ink tank package according to any one of claims 1 to 3, wherein the ink tank is provided with an ink absorbing body for holding ink through a capillary force.

5. The ink tank package according to claim 4, wherein the ink tank is removably mounted in an ink jet recording apparatus performing recording operations by discharging ink.

6. The ink tank package according to any one of claims 1 to 3, wherein the ink tank is removably mounted in an ink jet recording apparatus performing recording operations by discharging ink.

7. The ink tank package according to claim 1, wherein the opening is the atmosphere communication port for providing communication between the interior of the ink tank and the outside atmosphere.

8. The ink tank package according to claim 1, wherein the second opening is the ink supplying port for supplying ink externally.

9. The ink tank package according to any one of claims 7 or 8, wherein the ink tank is removably mounted in an ink jet recording apparatus performing recording operations by discharging ink.

10. A method of unsealing an ink tank package, wherein the ink tank package includes:

a container containing therein an ink tank; and a lid unsealably blocking up an unloading port for removing the ink tank from the container;

wherein the lid of the package includes a first unsealing portion and a second unsealing portion that are mutually bendably connected together, wherein there is provided a connection to the first unseating portion at a part of a sealing member for sea1ing an opening in the ink tank;

wherein said method comprises the steps of:

unsealing the first unsealing portion from the unloading port prior to the second unsealing portion, whereby peeling the sealing member off the opening in the ink tank; and unsealing the second unsealing portion from the unloading port, whereby allowing the ink tank to be unloaded from the container.

11. A method of unsealing an ink tank package, wherein the ink tank package includes:

a container containing therein an ink tank; and a lid unsealably blocking up an unloading port for removing the ink tank from the container;

wherein the lid of the package includes a first unsealing portion and a second unsealing portion that are mutually bendably connected together, wherein there is provided a connection to the first unsealing portion at a part of a sealing member for sealing an open in the ink tank;

wherein the opening in the ink tank includes an ink supplying port for supplying ink externally and an atmosphere communication port for providing communication between an interior of the ink tank and atmosphere;

wherein the sealing member seals at least the ink supplying port from atmosphere; and wherein the atmosphere communication port in the opening in the ink tank is sealed by the sealing member at a position closer to the connection along the sealing member than a position of sealing of the ink supplying port sealed by the sealing member;

wherein said method comprises the steps of:

unsealing the first unsealing portion from the unloading port, whereby involving the sealing member being peeled off the atmosphere communication port and the ink supplying port, in that order; and unsealing the second unsealing portion from the unloading port, whereby allowing the ink tank to be unloaded from the container.

12. A method of unsealing an ink tank package, wherein the ink tank package includes:

a container containing therein an ink tank; and a lid unsealably blocking up an unloading port for removing the ink tank from the container;

wherein the lid of the package includes a first unsealing portion and a second unsealing portion that are mutually bendably connected together, wherein there is provided a connection to the first unsealing portion at a part of a sealing member for sealing an opening in the ink tank; and wherein there is provided a connection to the second unsealing portion at a part of a second sealing member for sealing a second opening, which is different from the opening in the ink tank;

wherein said method comprises the steps of:

unsealing the first unsealing portion from the unloading port prior to the second unsealing portion, whereby peeling the first sealing member off the atmosphere communication port in the ink tank; and unsealing the second unsealing portion from the unloading port, whereby peeling the second sealing member off the ink supplying port of the ink tank and allowing the ink tank to be unloaded from the container.

13. A method of unsealing an ink tank package, wherein the ink tank package includes:

a container containing therein an ink tank; and a lid unsealably blocking up an unloading port for removing the ink tank from the container;

wherein the lid of the package includes a first unsealing portion and a second unsealing portion that are mutually bendably connected together, wherein there is provided a connection to the first unsealing portion at a part of a sealing member for sealing an opening in the ink tank;

wherein said method comprises the steps of:

unsealing the first unsealing portion from the unloading port prior to the second unsealing portion, whereby peeling the sealing member off the opening in the ink tank; and unsealing the second unsealing portion from the unloading port, whereby allowing the ink tank to be unloaded from the container; and wherein the ink tank is removably mounted in an ink jet recording apparatus performing recording operations by discharging ink.

14. A method of unsealing an ink tank package, wherein the ink tank package includes:

a container containing therein an ink tank; and a lid unsealably blocking up an unloading port for removing the ink tank from the container;

wherein the lid of the package includes a first unsealing portion and a second unsealing portion that are mutually bendably connected together, wherein there is provided a connection to the first unsealing portion at a part of a sealing member for sealing an opening in the ink tank;

wherein the opening in the ink tank includes an ink supplying port for supplying ink externally and an atmosphere communication port for providing communication between an interior of the ink tank and atmosphere;

wherein the sealing member seals at least the ink supplying port from atmosphere;

wherein the atmosphere communication port in the opening in the ink tank is sealed by the sealing member at a position closer to the connection along the sealing member than a position of sealing of the ink supplying port sealed by the sealing member;

wherein the method comprises the steps of:

unsealing the first unsealing portion from the unloading port, whereby involving the sealing member being peeled off the atmosphere communication port and the ink supplying port, in that order; and unsealing the second unsealing portion from the unloading port, whereby allowing the ink tank to be unloaded from the container;

wherein the ink tank is removably mounted in an ink jet recording apparatus performing recording operations by discharging ink.

15. A method of unsealing an ink tank package, wherein the ink tank package includes:

a container containing therein an ink tank; and a lid unsealably blocking up an unloading port for removing the ink tank from the container;

wherein the lid of the package includes a first unsealing portion and a second unsealing portion that are mutually bendably connected together, wherein there is provided a connection to the first unsealing portion at a part of a sealing member for sealing an opening in the ink tank; and wherein there is provided a connection to the second unsealing portion at a part of a second sealing member for sealing a second opening, which is different from the opening in the ink tank.

wherein said method comprises the steps of:

unsealing the first unsealing portion from the unloading port prior to the second unsealing portion, whereby peeling the first sealing member off the atmosphere communication port in the ink tank; and unsealing the second unsealing portion from the unloading port, whereby peeling the second sealing member off the ink supplying port of the ink tank and allowing the ink tank to be unloaded from the container;

wherein the ink tank is removably mounted in an ink jet recording apparatus performing recording operations by discharging ink.

* * * * *

UNITED STATES PATENT AND TRADEMARK OFFICE

CERTIFICATE OF CORRECTION

PATENT NO. : 7,275,816 B2
APPLICATION NO. : 10/981638
DATED : October 2, 2007
INVENTOR(S) : Kayo Mukai et al.

It is certified that error appears in the above-identified patent and that said Letters Patent is hereby corrected as shown below:

COLUMN 1

Line 40, “of f” should read --off--.

COLUMN 2

Line 49, “of f” should read --off--.

COLUMN 10

Line 1, “unseat-” should read --unseal- --;
Line 2, “sea1ing” should read --sealing--; and
Line 22, “open” should read --opening--.

Signed and Sealed this

Twelfth Day of August, 2008

JON W. DUDAS
*Director of the United States Patent and Trademark Office*